United States Patent [19]

Ruff

[11] Patent Number: 4,732,341

[45] Date of Patent: Mar. 22, 1988

[54] WINDING MACHINE FOR WINDING A WEB SLIT LENGTHWISE

[75] Inventor: Hans-Albrecht Ruff, Heidenheim, Fed. Rep. of Germany

[73] Assignee: J.M. Voith, GmbH, Heidenheim, Fed. Rep. of Germany

[21] Appl. No.: 930,293

[22] Filed: Nov. 13, 1986

[30] Foreign Application Priority Data

Nov. 27, 1985 [DE] Fed. Rep. of Germany ..... 3541906

[51] Int. Cl.[4] ..... B65H 19/30

[52] U.S. Cl. ..... 242/56.4; 242/56.9; 242/66

[58] Field of Search ..... 242/55, 56 R, 56.2, 242/56.4, 56.6, 56.9, 58, 58.6, 65, 66, 41, 67.1 R, 80

[56] References Cited

U.S. PATENT DOCUMENTS 3,406,925 10/1968 Waterhouse ..... 242/66
3,658,272 4/1972 Bennett et al. ..... 242/66
4,508,283 4/1985 Beisswanger ..... 242/56.4

FOREIGN PATENT DOCUMENTS 1217482 12/1970 United Kingdom .

*Primary Examiner*—David Werner
*Attorney, Agent, or Firm*—Jeffers, Hoffman & Niewyk

[57] ABSTRACT

A winding machine is provided with three support rollers horizontally aligned with parallel longitudinal axes and cooperating to define winding beds therebetween. The support rollers are arranged for simultaneously winding the alternate strips of a web slit lengthwise into at least two wound rolls in alternate winding beds. Each sidewall or front surface of the wound rolls cooperates with a winding frame, which guides the wound roll. Ejection apparatus are provided for each of the wound rolls and are mounted generally vertically disposed above the middle support roller in the machine. Each ejection apparatus has at least one rocking lever with a pressure bar at its lower end for each of the wound rolls, which rocking levers are mounted on longitudinally displaceable carriages. The rocking lever pressure bar has a length less than one-half the width of the narrowest wound roll and contacts the wound roll to move it from the winding machine.

7 Claims, 3 Drawing Figures

III
III
14
27
33
52
51
50
31
36
23
21
21
38
41
39
44
44
47,48
49
46
18
15
19
16
17
53
54

21
II
25
24
16
38
40
41
39
35
18
47
48
15
33
45
28
44
30
49
46
32
51
31
43
27
19
37
36
II
17
23
25
24
22

WINDING MACHINE FOR WINDING A WEB SLIT LENGTHWISE

BACKGROUND OF THE INVENTION

The invention relates to a winding machine for simultaneously winding the strips of a web slit lengthwise onto at least two winding rolls.

A winding machine is disclosed in DE-OS No. 32 43 994 corresponding to U.S. Pat. No. 4,508,283 wherein webs being processed, which can have a width up to ten m., are slit into a plurality of strips and wound onto rolls in two winding beds. Each winding bed has an ejection device above the middle support roller for removing fully wound rolls from the machine. Each ejection device has a girder extending the length of the middle support roller and mounted at its ends on two levers which can be rotated around the middle roller axis. High bending forces act on the girder during removal of relatively heavy, fully wound rolls from the appropriate winding bed. The girder, therefore, has a large cross-section to accommodate this bending force or stress.

SUMMARY OF THE INVENTION

The present invention provides a winding machine with an ejection apparatus which requires less space above the middle support roller. The winding machine for simultaneously winding the strips of a web slit lengthwise into at least two wound rolls, has a machine frame, three support rollers mounted on the frame adjacent one another with parallel axes, the middle and each adjacent outer or side roller, respectively, forming an upper wedge space between their respective peripheries as winding beds to alternately receive the web strips. Adjustable winding frames are vertically mounted on the machine frame above the winding beds at a separation plane defined between consecutive web strips, which winding frames guide the wound rolls on both sides thereof. Ejection devices for the wound rolls are generally positioned above the middle support roller and include operable rocking levers with support pressure bars parallel to the axis of the support rollers at lower ends of the levers with at least one rocking lever associated with each winding frame. The pressure bar has an effective length corresponding to one-half or less of the width of the narrowest wound roll or reel.

The ejection means of the present invention includes the advantage that one ejection device is individually provided for each wound roll. These ejection apparatus are subject to relatively little stress and, therefore, their dimensions are smaller than known devices. The smaller dimensions of the ejection devices allow both winding beds defined above the support rollers to be moved closer together above the middle support roller which allows production of larger diameter wound rolls. Alternative embodiments of the above-noted ejection devices include moderately prestressed rocking levers to overcome any nominal stress incurred during wound reel removal, and the pressure bar engagement may be at a relatively deep position within the corresponding winding bed to accommodate removal of even small, wound rolls. The winding machine lever arms or rocking levers taught above provide accommodation or construction of an ejection device that is stable under torsion.

BRIEF DESCRIPTION OF THE DRAWINGS

In the figures of the drawing, like reference numerals identify like components, and in the drawing.

DETAILED DESCRIPTION OF THE INVENTION

Figure 1:
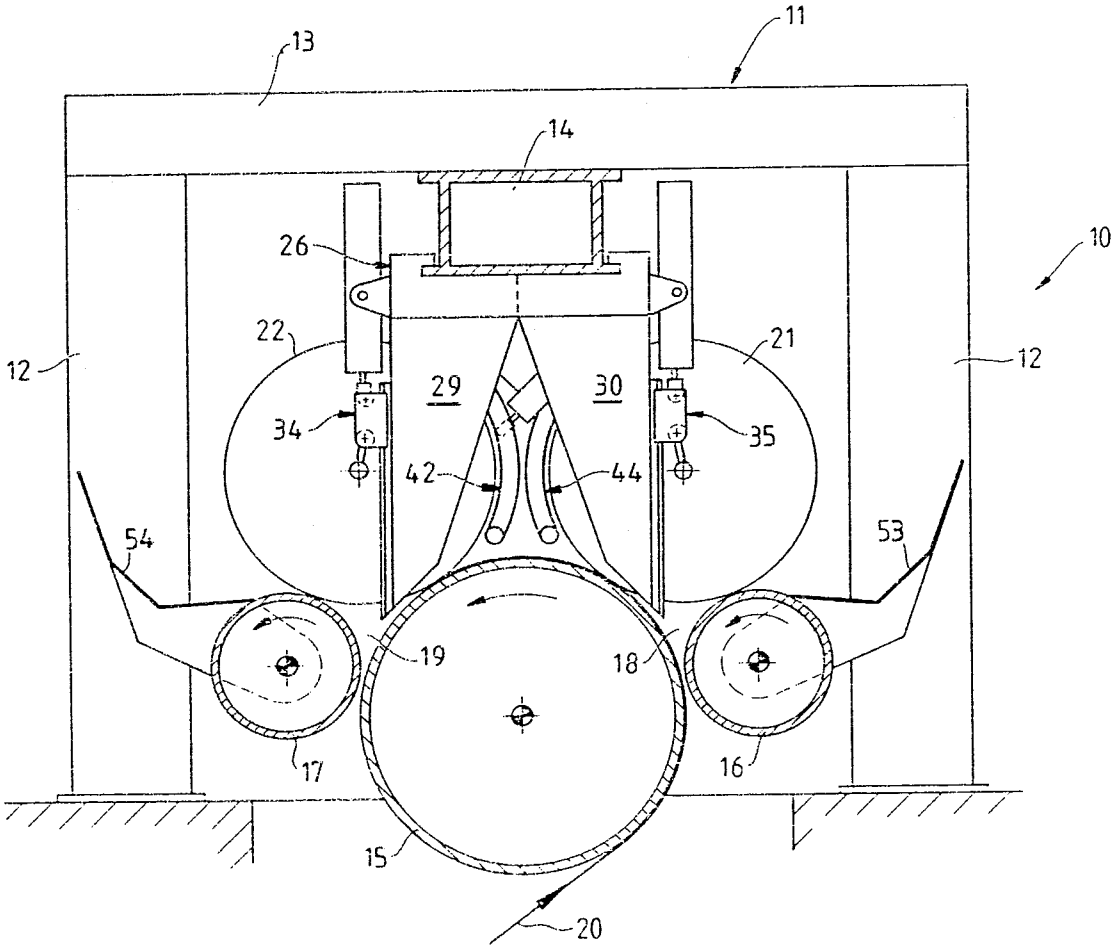
FIG. 1 illustrates a winding machine in cross-section with three support rollers, with ejection means for wound reels provided above the center support roller.

A winding machine 10 in FIG. 1 has a machine frame 11 with upright supports 12 arranged at the corners thereof, which uprights are connected by transoms or cross beams 13. Transoms 13 are connected in the center of machine 10 by a longitudinal girder 14. Three support rollers 15, 16 and 17 are arranged next to each other with longitudinal axes parallel to each other in machine frame 11. The longitudinal axes of rollers 15–17 are parallel to the longitudinal axis of girder 14. Each of these support rollers 15–17 is provided with a drive means (not shown). Outer support rollers 16 and 17 are positioned at the same relative vertical location within machine frame 11 and have the same diameter, which is less than the diameter of middle roller 15. Further, the longitudinal axis of roller 15 is vertically lower than that of outer rollers 16 and 17. The outer support rollers 16 and 17 are horizontally displaced one on either side of middle roller 15. Each of the outer support rollers 16 and 17 cooperate with middle roller 15 to define in the space vertically above their upper peripheral parts or segments, that is, in the generally wedge-shaped space therebetween, a winding bed extending above the central axial plane defined by the axes of middle roller 15 and the cooperating outer roller 16 or 17. Thus, outer support roller 16 cooperating with middle roller 15 defines first winding bed 18 thereabove, and outer support roller 17 cooperating with middle roller 15 defines second winding bed 19 therebetween and vertically above.

Figure 3:
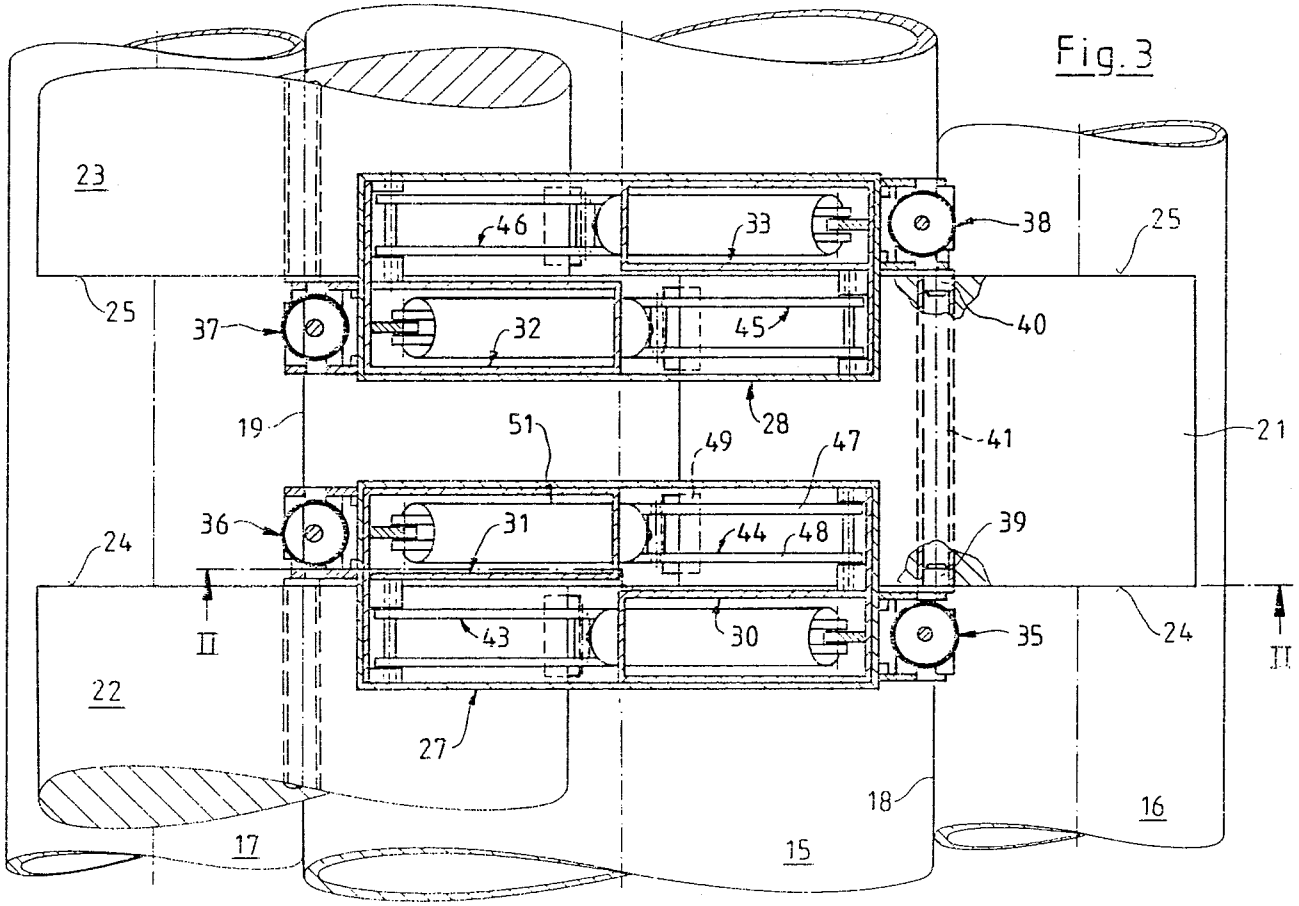
FIG. 3 illustrates a section through the machine along the line III—III in FIG. 2.

The strips of a web 20 slit lengthwise in a slitting appliance and operation (not shown) are supplied to winding machine 10 from a location vertically below middle roller 15. The strips of web 20 are displaced in FIG. 1 perpendicular to the plane of that FIG. 1 and are wound around an arc segment of circumference of middle support roller 15. Alternate strips of web 20 are wound or reeled onto paper cores 41, that is, the first, third, fifth, etc., web strips (counting from the front or illustrated section of the machine) are reeled onto cores 41 in first winding bed 18, while the second, fourth, etc., web strips are wound onto paper cores (not shown) in second winding bed 19. As shown in FIG. 3, the third web strip is wound into reel 21 in first winding bed 18. The second web strip is formed as wound reel or roll 22, and the fourth web strip is formed as wound roll 23 in second winding bed 19. As illustrated in FIG. 3, the web strips alternately enter first winding bed 18 and second winding bed 19, and thereby define an axial spacing between wound rolls in the same first or second winding bed 18 or 19. The axial spacing corresponds to the width of the wound reel produced on the corresponding wound reel of the other winding bed. As noted in FIG. 3, corresponding surfaces or edges of wound rolls in the first and second winding beds cooperate to define a separating plane between the respective consecutive web strips formed on the reels of the first and second winding beds. In FIG. 3, wound roll or reel 21 cooperates with wound roll or reel 22 to define separating plane 24 in their aligned surfaces or edges and similarly reel 21 cooperates with reel 23 to define a separating plane 25 between their aligned surfaces or edges. Each wound roll has a first edge and a second edge.

Figure 2:
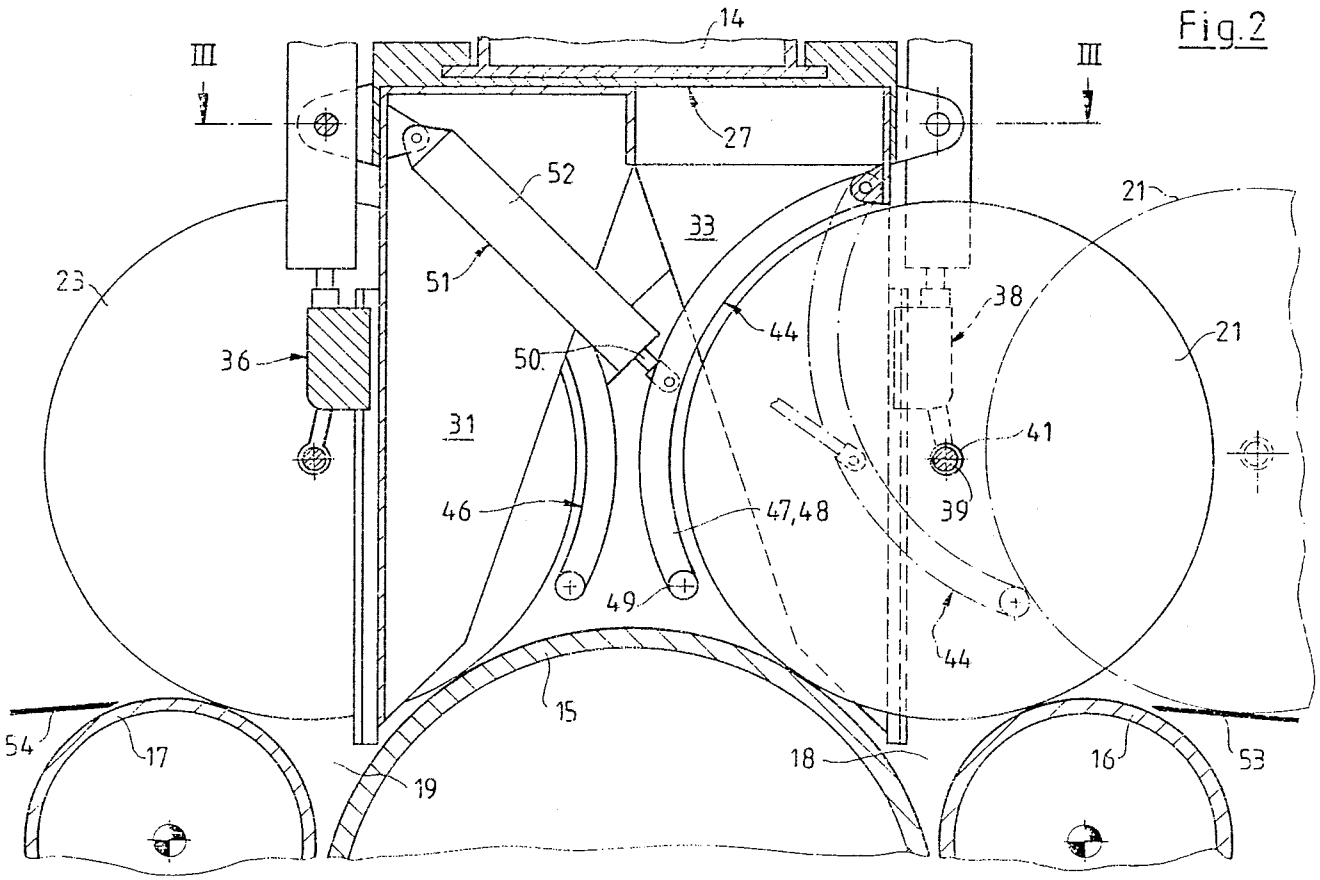
FIG. 2 shows a section on an enlarged scale of the winding machine above the winding beds along line II—II in FIG. 3.

Longitudinally displaceable carriages 26, 27 and 28 are mounted on girder 14 in FIG. 3 and support winding frames 29, 30, 31, 32, and 33, which frames 29–33 extend vertically downward in the orientation of FIG. 1 into the respective first or second winding beds 18, 19 to guide wound rolls 21, 22 or 23, as shown in FIGS. 1–3. Winding frames 29–33 are each equipped with a core guide 34, 35, 36, 37 and 38, respectively, and grips 39, 40, which grip the center, for example, of winding reels 21, 22 or 23 by engaging the ends of a paper core 41 therefor (FIG. 3).

Ejection devices 42, 43, 44, 45 and 46 are provided above middle support roller 15 in frame 11 for the ejection of full winding reels 21, 22, 23, etc., from the appropriate first winding bed 18 or second winding bed 19. Cooperating with each outer support roller 16 or 17, respectively, is an assigned delivery device 53 or 54, to receive the fully wound rolls (such as 21, 22 or 23) as they are ejected from machine 10. Construction of these ejection devices 42–46 is more fully defined in detail with reference to FIGS. 2 and 3.

In FIG. 3, winding frame 30 for wound roll 21 and winding frame 31 for wound roll 22 are secured in carriage 27. With reference to the perpendicular orientation of the web strips from the plane of the paper, as discussed above, winding frame 30 extends in front of separating plane 24 defined by web strip surfaces of reels 21 and 22, but winding frame 31 lies behind this separating plane 24. Winding frame 30 is operably connected to wound roll ejection apparatus 44 and winding frame 31 is operably connected to ejection apparatus 43. Ejection devices 43 and 44 may simultaneously extend from winding frames 30 and 31, respectively, on opposite sides of separating plane 24. In a corresponding manner, winding frames 32 and 33 with ejection devices 45 and 46, respectively, are positioned in carriage 28 on either side of separating plane 25. Winding frames 30 and 33 are outside the width of wound roll 21 defined in winding bed 18. However, ejection devices 44 and 45 of winding frames 30 and 33, respectively, lie within the wound roll distance or gap longitudinally defined by wound roll 21 between separating planes 24 and 25. The arrangement of the winding frames and ejection apparatus in the remaining wound reels is carried out in a corresponding or similar manner.

Operation of the ejection apparatus will be discussed and described utilizing ejection apparatus 44, and the remaining ejection apparatus of winding machine 10 have a similar construction and operational mode. Ejection apparatus 44 includes two congruent levers 47, 48, each with the same general shape and small cross section. As illustrated in FIGS. 1 and 2, lever 47 is positioned behind lever 48, and both levers have a curvature following the maximum circumference of wound roll 21 and cooperate with this maximum wound roll to define a small spacing or gap therebetween at a reference or non-operating position. Levers 47, 48 are pivotable on winding frame 30 at a pivot point just above (as shown in FIG. 2) the maximum diameter of wound roll 21. In the reference or rest position (noted as solid lines in FIG. 2), rocking levers 48 and 47 have a pressure bar 49 secured at their free ends and they extend into proximity of middle support roller 15. Pressure bar 49 is a generally pipe or tube shaped section with a longitudinal axis parallel to the axis of wound roll 21. However, pressure bar 49 is less than half the width of the narrowest wound roll 21 which may be produced on machine 10. A thrust motor 51 (pneumatic or hydraulic cylinder) has a piston rod 50 connected to and operating on the levers 47 and 48 generally at their middle section. Thrust motor 51 extends into and is secured to winding frame 31 opposite ejection apparatus 44 and on the same side of separating plane 24. Cylinder 52 of thrust motor 51 is supported on carriage 27 in the region of winding frame 31.

The ejection apparatus operates generally as follows and will be discussed utilizing wound roll 21 as an example. Rolls or reels 21–23 are wound on paper cores, such as 41, until they have attained a predetermined diameter. The drive of support rollers 15–17 is stopped and grips 39, 40 of core guides 35 and 38 are retracted from paper core 41. Thus, wound roll 21 is released from winding frames 30 and 33. Thrust motors 51 of ejection apparatus 44, 45 (as shown in FIG. 3) are actuated with a working medium (pneumatic or hydraulic) to move the levers 47, 48 of apparatus 44 and similarly the lever arms of apparatus 45 in a counterclockwise direction. Pressure bars 49 of ejection apparatus 44, 45 contact the circumference of wound roll 21. Driven rods or levers 47, 48 of apparatus 44, 45 pivot to move pressure bar 49 into contact with roll 21 and thereby raise the wound roll 21 from middle support roller 15 to push or roll it over support roller 16. Wound roll 21 thereafter moves onto delivery device 53 (shown in FIG. 2 in broken lines) and is ejected by a pivoting motion in the clockwise direction from machine 10. The driving or thrust means provided to thrust motors 51 is relieved and rocking levers 47, 48 of ejection apparatus 44, 45 are brought into their rest or reference position above middle support roller 15. This operating sequence is carried out simultaneously for all the ejection apparatus of machine 10.

While only particular embodiments of the present invention have been shown and described, it is manifest that these are in no way limiting on the scope of the invention described and claimed herein.

What is claimed is:

1. A winding machine for simultaneously winding the strips of a web slit lengthwise into at least two wound rolls each of said wound rolls having a first edge and a second edge, said winding machine comprising:

a machine frame;

a middle support roller, a first outer support roller and a second outer support roller, each roller defining a longitudinal axis and mounted on the machine frame adjacent one another with their longitudinal axes parallel, each of said middle and outer rollers defining a periphery, said middle support roller cooperating with each of said first and second outer support rollers, respectively, to define between their respective peripheries a first upper wedge space and a second upper wedge space, respectively, which have first and second winding beds therein to alternately receive said web strips;

said web strips defining a separating plane at each edge of said wound rolls;

adjustable winding frames mounted on said machine frame above said winding beds along each of said separating planes, said winding frames guiding the wound rolls at both edges thereof;

ejection apparatus for said wound rolls generally positioned above said middle support roller and including operable rocking levers in proximity to each edge of each wound roll, each rocking lever defining a lower end with support pressure bars at said lower ends, which pressure bars are parallel to the axes of said middle, first outer and second outer support rollers, said ejection apparatus characterized in that each of said winding frames comprises at least one rocking lever with a pressure bar which contacts said wound roll at its circumference, said pressure bar has a length less than one half the width of the narrowest wound roll.

2. A winding machine as claimed in claim 1, characterized in that at least one rocking lever is on the wound roll side of each of the separating planes.

3. A winding machine as claimed in claim 2, characterized in that each of said rocking levers is mounted on said winding frame at a point just above the maximum diameter of a wound roll producible in the winding machine and has a curvature following the maximum circumference of this maximum diameter wound roll but at a distance therefrom.

4. A winding machine as claimed in claim 2 wherein each of said winding frames has two rocking levers at each edge of each wound roll mounted along and pivotable about the same longitudinal axis, which axis is parallel with said middle and outer roller axes, said rocking levers connected at their lower ends by said pressure bar.

5. A winding machine as claimed in claim 3 wherein each of said winding frames has two rocking levers at each edge of each wound roll mounted along and pivotable about a longitudinal axis, which axis is parallel to the middle and outer roller axes, said rocking levers connected at their lower ends by said pressure bar.

6. A winding machine according to claim 1 wherein each of said winding frames has two rocking levers at each edge of each wound roll mounted along and pivotable about the same longitudinal axis, which axis is parallel with said middle and outer roller axes, said rocking levers connected at their lower ends by said pressure bar.

7. A winding machine for simultaneously winding the strips of a web slit lengthwise into at least two wound rolls, each of said wound rolls having a first edge and a second edge, said winding machine comprising:

a machine frame;

a middle support roller, a first outer support roller and a second outer support roller, each roller defining a longitudinal axis and mounted on the machine frame adjacent one another with their longitudinal axes parallel, each of said middle and outer rollers defining a periphery, said middle support roller cooperating with each of said first and second outer support rollers, respectively, to define between their respective peripheries a first upper wedge space and a second upper wedge space, respectively, which have first and second winding beds therein to alternately receive said web strips;

said web strips defining a separating plane at each edge of said wound rolls;

adjustable winding frames mounted on said machine frame above said winding beds along each of said separating planes, said winding frames guiding the wound rolls at both edges thereof;

ejection apparatus for said wound rolls generally positioned above said middle support roller and including operable rocking levers in proximity to each of each wound roll, each rocking lever defining a lower end with support pressure bars at said lower ends which pressure bars are parallel to the axes of said middle, first outer and second outer support rollers, said ejection apparatus characterized in that each of said winding frames comprises at least one rocking lever having a pressure bar with a length less than one half the width of the narrowest wound roll, said at least one rocking lever positioned on the wound roll side of each of said separating planes, each of said rocking levers mounted on said winding frame at a point just above the maximum diameter of a wound roll producible in the winding machine and said rocking lever having a curvature following the maximum circumference of the maximum diameter wound roll but at a distance therefrom.

* * * * *

UNITED STATES PATENT AND TRADEMARK OFFICE

CERTIFICATE OF CORRECTION

PATENT NO. : 4,732,341

DATED : March 22, 1988

INVENTOR(S) : Hans-Albrecht Ruff

It is certified that error appears in the above-identified patent and that said Letters Patent is hereby corrected as shown below:

Claim 7, Col. 6, line 30, after "each" first occurrence, insert --edge--.

Signed and Sealed this

Eighteenth Day of October, 1988

*Attest:*

DONALD J. QUIGG

*Attesting Officer*

*Commissioner of Patents and Trademarks*